US007918274B2

(12) United States Patent
Thornton

(10) Patent No.: US 7,918,274 B2
(45) Date of Patent: Apr. 5, 2011

(54) DOWNHOLE TOOLS

(76) Inventor: Thomas John Oliver Thornton, London (GB)

( * ) Notice: Subject to any disclaimer, the term of this patent is extended or adjusted under 35 U.S.C. 154(b) by 94 days.

(21) Appl. No.: 12/223,662

(22) PCT Filed: Feb. 8, 2007

(86) PCT No.: PCT/GB2007/000415
§ 371 (c)(1),
(2), (4) Date: Mar. 16, 2009

(87) PCT Pub. No.: WO2007/091054
PCT Pub. Date: Aug. 16, 2007

(65) Prior Publication Data

US 2009/0242193 A1 Oct. 1, 2009

(30) Foreign Application Priority Data

Feb. 8, 2006 (GB) ..... 0602512.6

(51) Int. Cl.
*E21B 17/10* (2006.01)

(52) U.S. Cl. ..... 166/241.2; 166/241.6; 175/325.5

(58) Field of Classification Search ..... 166/241.2, 166/241.3, 241.4, 241.6; 175/325.5
See application file for complete search history.

(56) References Cited

U.S. PATENT DOCUMENTS

| | | | | |
|---|---|---|---|---|
| 5,456,327 | A | 10/1995 | Denton et al. | |
| 2003/0010540 | A1 * | 1/2003 | Kirk et al. | 175/325.5 |
| 2003/0066641 | A1 * | 4/2003 | Yamamoto et al. | 166/242.6 |
| 2007/0051520 | A1 * | 3/2007 | Parker | 166/380 |

FOREIGN PATENT DOCUMENTS

| | | |
|---|---|---|
| GB | 847800 | 9/1960 |
| JP | 08 233163 | 9/1996 |
| JP | 08 233164 | 9/1996 |
| JP | 09 072467 | 3/1997 |
| JP | 2003-226913 | 8/2003 |

OTHER PUBLICATIONS

European Office Action datedSep. 14, 2009, 3 pages.
International Search Report PCT/GB2007/000415, dated May 18, 2007.

* cited by examiner

*Primary Examiner* — William P Neuder
(74) *Attorney, Agent, or Firm* — Sean P. O'Hanlon, Esq., PLLC

(57) ABSTRACT

There is disclosed an improved tool, e.g. adapted to comprise at least part of a well completion assembly or well drilling assembly. The invention provides an improved downhole tool (or device) having a friction factor of the order of ten times less than those known from the prior art, e.g. of the order of 0.100 or less. Accordingly the invention provides a downhole tool (10; 10*a;* 10*b;* 10*c;* 10*d*), at least part of the downhole tool or device being made from Tungsten Disulphide (Tungsten Disulfide). In a disclosed embodiment the at least part comprises at least one surface of the downhole tool, the at least one surface comprising a bearing surface, e.g. a journal bearing surface and/or a thrust bearing surface.

65 Claims, 6 Drawing Sheets

Friction as a function of pressure

DOWNHOLE TOOLS

FIELD OF INVENTION

The present invention relates to downhole tools, devices, apparatus, assemblies, or equipment.

The invention particularly, though not exclusively, relates to a downhole tool, device or component adapted to comprise at least part of a well completion assembly or well drilling assembly. For example, the invention relates to an improved centraliser for centralisation of tubulars such as casings, liners, production screens, production tubing and the like in oil/gas wells. The invention also, for example, relates to an improved protector or stabiliser for spacing of tubulars such as drill pipe from rugous bore walls during drilling of oil/gas wells. The invention also, for example, relates to an improved tubular, e.g. for use in a well completion, such as a drill pipe, a casing, a liner production screen or a production tubing, e.g. for use in drilling and/or completing a well. The invention also, for example, relates to an improved tubular, e.g. for use in well drilling, such as drill pipe.

The invention also relates to other downhole tools and equipment, such as downhole intervention, completion and logging equipment.

BACKGROUND TO INVENTION

As a borehole is drilled it is necessary to secure the borehole walls to prevent collapsing and to provide a mechanical barrier to wellbore fluid ingress and drilling fluid egress. This is achieved by cementing in casings. Casings are tubular sections positioned in the borehole, and the annular space between the outer surface of the casing and the borehole wall is conventionally filled with a cement slurry.

After the well has been drilled to its final depth it is necessary to secure a final borehole section. This is performed by either leaving the final borehole section open (termed an open hole completion), or by lining the final borehole section with a tubular such as a liner (hung off the previous casing) or casing (extending to the surface), whereby the annular space between the liner or casing and the borehole is filled with a cement slurry (termed a cased hole completion).

Production tubing is then run into the lined hole and is secured at the bottom of the well with a sealing device termed a "packer" which seals the annulus so formed between the production tubing and the outer casing or liner. At the top of the well the production tubing is fixed to a wellhead/Christmas tree combination. This production tubing is used to evacuate the hydrocarbon.

In some instances instead of running a final liner string, the final borehole section is left open and screens are run. Screens are typically perforated production tubing having either slits or holes. These screens once in position act as a conduit in a procedure to fill the annular void between the borehole wall and the screen by placing sand around the screen. The sand acts as a filter and as a support to the borehole wall. The term used for this operation is "gravel packing".

In each case centralising or otherwise locating a tubular within a borehole or within another tubular is necessary to ensure tubulars do not strike or stick against the borehole wall or wall of the other tubular, and that a substantially exact matching of consecutive tubulars positioned in the borehole is achieved, while allowing for an even distribution of materials, e.g. cement or sand, placed within the annulus formed.

Centralisers or "protectors" for drill strings or drill pipe used to aid in the directing of a drill bit within a borehole are documented. Examples are GB 2 353 549 A (WESTERN WELL TOOL), U.S. Pat. No. 6,250,405 (WESTERN WELL TOOL), and US 2004188147 (WESTERN WELL TOOL).

More recently casing centralisers have been described which aim to keep casing away from the borehole wall and/or aid the distribution of cement slurry in the annulus between the outer surface of the casing and the borehole wall. Examples of casing centralisers are given below.

U.S. Pat. No. 5,095,981 (MIKOLAJCZYK) discloses a casing centraliser comprising a circumferentially continuous tubular metal body adapted to fit closely about a joint of casing, and a plurality of solid metal blades fixed to the body and extending parallel to the axis of the body along the outer diameter of the body in generally equally spaced apart relation, each blade having opposite ends which are tapered outwardly toward one another and a relatively wide outer surface for bearing against the well-bore or an outer casing in which the casing is disposed, including screws extending threadedly through holes in at least certain of the blades and the body for gripping the casing so as to hold the centraliser in place.

EP 0 671 546 A1 (DOWNHOLE PRODUCTS) discloses a casing centraliser comprising an annular body, a substantially cylindrical bore extending longitudinally through said body, and a peripheral array of a plurality of longitudinally extending blades circumferentially distributed around said body to define a flow path between each circumferentially adjacent pair of said blades, each said flow path providing a fluid flow path between longitudinally opposite ends of said centraliser, each said blade having a radial outer edge providing a wellbore contacting surface, and said cylindrical bore through said body being a clearance fit around casing intended to be centralised by said casing centraliser, the centraliser being manufactured wholly from a material which comprises zinc or a zinc alloy.

WO 98/37302 (DOWNHOLE PRODUCTS) discloses a casing centraliser assembly comprising a length of tubular casing and a centraliser of unitary construction (that is, made in one piece of a single material and without any reinforcement means) disposed on an outer surface of the casing, the centraliser having an annular body, and a substantially cylindrical bore extending longitudinally through the body, the bore being a clearance fit around the length of the tubular casing, characterised in that the centraliser comprises a plastic, elastomeric and/or rubber material.

WO 99/25949 (BRUNEL OILFIELD SERVICES) also discloses an improved casing centraliser.

The content of the aforementioned prior art documents are incorporated herein by reference.

As is apparent from the art, many centralisers have been developed to overcome problems pertaining to centralising a tubular and distributing an annulus material. These centralisers are of unitary assembly and are made of a plastic, or more generally, a material such as zinc, steel or aluminium. However, in selecting a single material a trade-off must be made as:

(a) the chosen material must provide a low friction surface against the smooth tubular outermost surface while being strong enough to withstand abrasion from rugous borehole walls;

(b) the chosen material must act as a journal bearing once the centraliser is in its downhole location, but during the running operation it must act as a thrust bearing.

Material such as plastic deforms, and may potentially ride over stop rings or casing collars. This may occur when the centraliser contacts ledges (possibly the ledges within the BOP stack cavities and wellhead) when run in a cased hole, or to ledges and rugous boreholes when run in open hole. The centraliser is driven along the tubular in the opposite axial direction to that of the tubular motion, and is driven into the rings and/or collars. Additionally, when the tubular is rotated (a common procedure when running tubular downhole, converting drag friction to torque friction) the "nose" of the centraliser is forced against a stop-collar and the tubular rotated—thus causing the centraliser nose to act as a thrust bearing. If the centraliser deforms and rides over the collar, the stretched material may jam the centraliser, and possibly the tool or assembly against the borehole wall. This problem is sought to be addressed in WO 02/02904 (BRUNEL OIL-FIELD SERVICES). The problem is illustrated in cross-section in FIG. 1 thereof.

The content of the aforementioned prior art document is incorporated herein by reference.

It is known that drill pipe connections can be "hard coated" with a material which is harder and more abrasive than the material from which the drill pipe is made so as to protect a drill string. This is because metals of similar hardness used for drill pipe and casing tend to gaul or "pick up", i.e. cause wear between themselves due to their similar hardness. "Pick up" could be mitigated by coating the drill pipe connections with a harder abrasive material such as Tungsten Carbide. Such has the benefit of acting to reduce wear of the drill pipe—which can be used in a number of wells—but the disadvantage of causing wear to the casing. As wells become deeper this wearing problem becomes more critical. Further, by having a very hard material, such may start to wear off. Whilst it will reduce friction—as it acts to reduce the gauling process—it is not low friction. Typical field observed results of drill pipe steel versus casing friction are of the order of 0.25 to 0.35, even in an oil based or lubricated medium.

Even with improvements to the art, there remains a desire to improve upon known downhole tools. There is also a desire to seek to reduce the aforementioned trade-off requirements.

Accordingly, it is an object of at least one embodiment of at least one aspect of the present invention to obviate or at least mitigate one or more problems and/or disadvantages in the prior art.

It is also an object of at least one embodiment of at least one aspect of the present invention to improve over the known art.

It is also an object of at least one embodiment of at least one aspect of the present invention to provide an improved downhole tool or device having a friction factor of the order of ten times less than those known from the prior art, e.g. of the order of 0.100 or less, e.g. 0.030 to 0.070.

SUMMARY OF INVENTION

According to a first aspect of the present invention there is provided a downhole tool or device, at least part of the downhole tool or device being made from Tungsten Disulphide (Tungsten Disulfide).

The at least part of the downhole tool or device may comprise at least one surface of the downhole tool or device.

The at least one surface may comprise a bearing surface, e.g. a journal bearing surface and/or a thrust bearing surface.

The at least one surface may comprise at least part of an innermost surface of the tubular member.

Additionally or alternatively, the at least one surface may comprise at least part of an outermost surface of the tubular member.

The downhole tool or device may comprise a centraliser, e.g. a casing centraliser. Alternatively, the downhole tool may comprise a centraliser for a liner or screen.

The downhole tool or device may comprise a protector, stabiliser or centraliser, e.g. a production tubing protector, stabiliser or centraliser.

The downhole tool or device may comprise a casing, e.g. a length of casing. In such case the at least part of the downhole tool or device may comprise a joint of the casing, e.g. at least part of an outermost surface of the joint. The joint may have an enlarged diameter as compared to a remainder of the casing.

The downhole tool or device may comprise a liner or production screen. In such case the at least part of the downhole tool or device may comprise a joint of the liner or production screen, e.g. at least part of an outermost surface of the joint. The joint may have an enlarged diameter as compared to a remainder of the liner or production screen.

The downhole tool or device may comprise a drill pipe. In such case the at least part of the downhole tool or device may comprise a joint of the drill pipe, e.g. at least part of an outermost surface of the joint. The joint may have an enlarged diameter as compared to a remainder of the drill pipe.

The downhole tool or device may comprise a tubular body, beneficially a one piece tubular body.

The tubular body may be made from a plastics material, e.g. a polymeric plastics material, and beneficially a thermoplastic.

The tubular body may be made from a metallic material, e.g. steel, iron, ductile iron, zinc or aluminium or an alloy of any of such. Low grade steel is beneficial in view of the price of such.

The tubular body may be made from an elastomeric and/or rubber material.

The Tungsten Disulphide may comprise a coating and may act as a permanent (coated on) very low friction dry lubricant. "Low friction" may be comparative to that of another part or a remainder of the downhole tool or device.

The low friction coating preferably may be applied at ambient temperature to form a molecular bond with a substrate material, e.g. the tubular body—whether plastic or material. The coating may be of the order of 0.5 micron thick. The coating may be applied by use of a jet or jets of refrigerated air.

The Inventor believes Tungsten Disulphide to be suitable for robust downhole use providing a very low coefficient of friction (as compared to materials conventionally used to fabricate downhole tools or devices), being chemically inert and withstanding temperatures of up to 650° C.

The Tungsten Disulphide may have an extensively modified lamellar composition, which may outperform other dry coating lubricants. The coating may comprise a dry metallic coating without use of heat, binders or adhesive. The coating may comprise a lubricant coating which bonds (instantly) to a substrate material, e.g. plastic, metal, resin, typically with a thickness of around 0.5 microns.

The coating may be single layer or laminar.

In the case of a downhole centraliser comprising a casing, liner or screen centraliser or a production tubing centraliser, in a first implementation the downhole centraliser may be adapted to be received on a downhole tubular, in use, so as to be a clearance fit around the downhole tubular such that the downhole centraliser is rotationally and longitudinally moveable relative to the downhole tubular, the downhole centraliser being a rigid tubular body, the tubular body having a first portion and at least one second portion, the first portion and the at least one second portion being statically retained relative to one another, the first portion comprising a tubular member providing an outermost surface of the tubular body, the first portion being substantially formed from a first material, and the at least one second portion comprising a ring member provided at or adjacent to one end of the tubular member, the at least one second portion being substantially formed from a second material, the first material having a lower Young's modulus than the second material, and wherein the first material substantially comprises a thermoplastic polymer.

The at least one second portion may comprise a further ring member provided at or adjacent to another end of the tubular member. At least a portion of an innermost surface of the tubular body may be provided by the ring member and optional further ring member.

In the case of a downhole centraliser comprising a casing, liner or screen centraliser or a production tubing centraliser, in a second implementation the downhole centraliser may be adapted to be received on a downhole tubular, in use, so as to be a clearance fit around the downhole tubular such that the downhole centraliser is rotationally and longitudinally moveable relative to the downhole tubular, the downhole centraliser being a rigid tubular body, the tubular body having at least one first portion and at least one second portion, the at least one first portion and the at least one second portion being statically retained relative to one another, the at least one first portion comprising at least a portion of an outermost surface of the tubular body, the at least one first portion being substantially formed from a first material, and the at least one second portion comprising at least a portion of an innermost surface of the tubular body, the at least one second portion being substantially formed from a second material, the first material having a lower Young's modulus than the second material, and wherein the first material substantially comprises a thermoplastic polymer.

The at least one first portion may comprise a tubular member providing the outermost surface of the tubular body, the tubular member being substantially formed from the first material, and the at least one second portion comprises a further tubular member extending from or adjacent to one end of the tubular member to or adjacent to another end of the tubular member.

The centralisers of the first and second implementations may be termed "composite" centralisers. These centralisers are therefore "non-unitary" in construction, that is to say, they are not formed in one piece from one material. They do, however, offer a centraliser in which parts made from the first and second materials are static relative to one another, in use. In other words, the centralisers are effectively "one-piece".

The Inventor has termed centralisers of the present invention the "EZEE-GLIDER" (Trade Mark) centraliser.

The or each first portion may be circumferentially integrally continuous, that is, formed in one piece.

In one implementation the material of the tubular body or first material may be a polyphthalamide (PPA), e.g. a glass-reinforced heat stabilised PPA such as AMODEL, available from Solvay Advanced Polymers (see http://www.solvayadvancedpolymers.com).

In another implementation the material of the tubular body or first material may be a polymer of carbon monoxide and alpha-olefins, such as ethylene.

Advantageously, the material of the tubular body or first material may be an aliphatic polyketone made from co-polymerisation of ethylene and carbon monoxide—optionally with propylene.

The material of the tubular body or first material may be selected from a class of semi-crystalline thermoplastic materials with an alternating olefin-carbon monoxide structure.

In a further implementation the material of the tubular body or first material may be a nylon resin. Advantageously the material of the tubular body or first material may be an ionomer modified nylon 66 resin. The material of the tubular body or first material may be a nylon 12 resin, e.g. RILSAN (Trade Mark) available from Elf Atochem.

In a yet further alternative implementation the material of the tubular body or first material may be a modified polyamide (PA).

The material of the tubular body or first material may be a nylon compound such as DEVLON (Trade Mark) available from Devlon Engineering Ltd.

The material of the tubular body or first material may be of the polyetheretherketone family, e.g. PEEK (Trade Mark) available from Victrex PLC.

The material of the tubular body or first material may be ZYTEL (Trade Mark) available from Du Pont. ZYTEL (Trade Mark) is a class of nylon resins which, includes unmodified nylon homopolymers (e.g. PA 66 and PA 612) and copolymers (e.g. PA 66/6 and PA 6T/MPMDT etc) plus modified grades produced by the addition of heat stabilizers, lubricants, ultraviolet screens, nucleating agents, tougheners, reinforcements etc. The majority of resins have molecular weights suited for injection moulding, roto-moulding and some are used in extrusion.

Alternatively the material of the tubular body or first material may be VESCONITE (Trade Mark) available from Vesco Plastics Australia Pty Ltd.

Alternatively the material of the tubular body or first material may be polytetrafluoroethylene (PTFE). In such case the material of the tubular body or first material may be TEFLON (Trade Mark) or a similar type material. PTFE or TEFLON (Trade Mark) filled grades of semi-crystalline thermoplastic materials with an alternating olefin-carbon monoxide structure may be used. These materials are suitable for roto-moulding which is a favoured method of manufacture for economic reasons for larger component sizes, e.g. greater than $9^{5/8}$" (245 mm). Alternatively, the material of the tubular body or first material may be PA66, FG30, PTFE 15 from ALBIS Chemicals.

The outermost surface of said body may provide or comprise a plurality of raised portions.

The raised portions may be in the form of longitudinally extending blades or ribs or may alternatively be in the form of an array of nipples or lobes.

Adjacent raised portions may define a flow path therebetween such that fluid flow paths are defined between first and second ends of the tubular body.

Where the raised portions comprise longitudinal blades, such blades may be formed, at least in part, substantially parallel to an axis of the tubular body.

Alternatively, the blades may be formed in a longitudinal spiral/helical path on the tubular body.

Advantageously adjacent blades may at least partly longitudinally overlap upon the tubular body.

Preferably adjacent blades may be located such that one end of a blade at one end of the tubular body is at substantially the same circumferential position as an end of an adjacent blade at another end of the tubular body.

More preferably, the blades may have an upper spiral portion, a middle substantially straight portion and a lower tapered portion.

The second material may be a metallic material.

Preferably, the second material may be a bronze alloy such as phosphur bronze or lead bronze, or alternatively, zinc or a zinc alloy.

In a preferred embodiment the second material is lead bronze. Bronze is advantageously selected as it has a high Young's Modulus (16,675,000 psi (115,000 MPa)) compared to ZYTEL (around 600,000 psi (4,138 MPa)) and AMODEL (870,000 psi (6,000 MPa)), while having friction properties which are better than steel.

Additionally, the centraliser may include a reinforcing means such as a cage, mesh, bars, rings and/or the like. The reinforcing means may be made from the second material.

At least part of a tool according to the present invention may be formed from a casting process.

Alternatively or additionally, at least part of the tool according to the present invention may be formed from an injection moulding process.

Advantageously, at least part of the tool according to the present invention may be formed from an injection moulding or roto-moulding process.

Tungsten Disulphide may have a coefficient of friction of less than or equal to 0.1, e.g. in the range 0.030 to 0.070, e.g. 0.030 or 0.070.

The coefficient of friction may be a dynamic coefficient of friction.

The coefficient of friction may be a static coefficient of friction.

According to a second aspect of the present invention there is provided a downhole tool or device having an outer surface at least part of which has a nonlubricated or dry coefficient of friction of around 0.1 or less.

Advantageously the friction factor (coefficient of friction) is around 0.090 or less, or 0.070 or less.

Advantageously the friction factor (coefficient of friction) is substantially 0.030 to 0.070, e.g. around 0.030 or 0.070.

The at least part of the outer surface may comprise or consist of Tungsten Disulphide.

The coefficient friction may be a dynamic coefficient of friction.

The coefficient of friction may be a static coefficient of friction.

Other optional features of the second aspect of the present invention may be the same as those of the first aspect of the present invention.

According to a third aspect of the present invention there is provided a downhole apparatus or assembly comprising at least one downhole tool or device according to the first or second aspects of the present invention.

The downhole apparatus or assembly may comprise a well completion assembly, or drill string, e.g. comprising a plurality of lengths of casing, a plurality of casing centralisers, a plurality of lengths of production tubing and/or a plurality of production tubing centralisers.

The downhole apparatus or assembly may comprise a drilling assembly or drill string, e.g. comprising a plurality of lengths of drill pipe and/or a plurality of drill pipe protectors, centralisers or stabilisers.

According to a fourth aspect of the present invention there is provided a method of completing a well comprising using a downhole tool or device according to the first or second aspects or a downhole apparatus or assembly according to the third aspect.

According to a fifth aspect of the present invention there is provided a method of drilling a well comprising using a downhole tool or device according to the first or second aspects or a downhole apparatus or assembly according to the third aspect.

BRIEF DESCRIPTION OF DRAWINGS

Embodiments of the invention will now be described, by way of example only, and with reference to the accompanying drawings, which are.

DETAILED DESCRIPTION OF DRAWINGS

Figure 1:
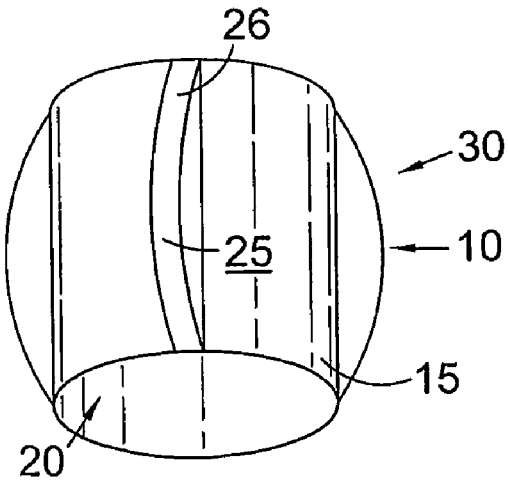
FIG. 1 a perspective view from one side and above of a first downhole tool comprising a casing centraliser according to an embodiment of the present invention.

Referring initially to FIG. 1 there is illustrated a downhole tool or device, generally designated 10, according to a first embodiment of the present invention, at least part of the downhole tool or device 10 being made from Tungsten Disulphide (Tungsten Disulfide). The at least part of the downhole tool or device 10 comprises at least one surface of the downhole tool or device 10. The at least one surface can comprise a bearing surface, e.g. a journal bearing surface and/or a thrust bearing surface. In this embodiment the downhole tool or device 10 comprises a tubular member 15. In one implementation the at least one surface comprises at least part of an innermost surface 20 of the tubular member 15. Additionally or alternatively, the at least one surface comprises at least part of an outermost surface 25 of the tubular member 15, which part may comprise part of a blade 26.

The downhole tool or device 10 comprises a centraliser 30, in this case a casing centraliser. In an alternative embodiment the downhole tool or device comprises a centraliser for a liner or screen.

In a further alternative embodiment the downhole tool or device comprises a production tubing protector, stabiliser or centraliser.

Figure 2:
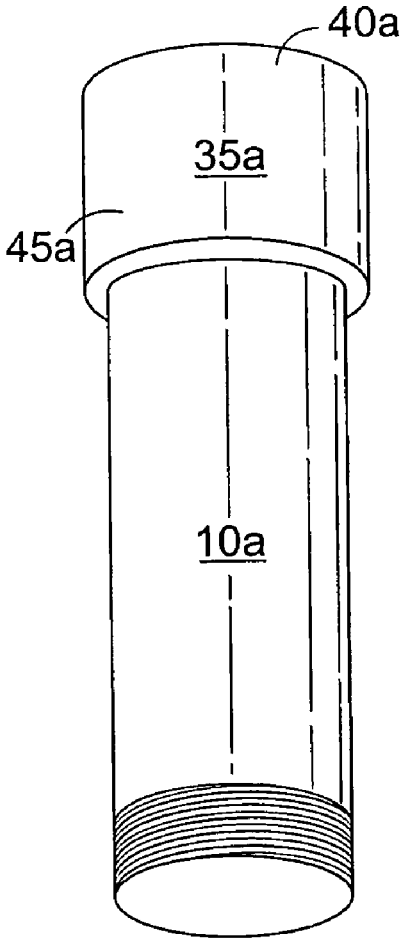
FIG. 2 a side view of a second downhole tool comprising a casing according to an embodiment of the present invention.

Referring to FIG. 2 in a yet further alternative embodiment a downhole tool or device 10*a* comprises a casing, e.g. a length of casing. In such case the at least part of the downhole tool or device 10*a* comprises a joint 35*a* of the casing, e.g. at least part 40*a* of an outermost surface 45*a* of the joint 35*a*. The joint 35*a* has an enlarged diameter as compared to a remainder of the casing.

In a still further alternative embodiment the downhole tool or device comprises a liner or production screen. In such case the at least part of the downhole tool or device comprises a joint of the liner or production screen, e.g. at least part of an outermost surface of the joint. The joint may have an enlarged diameter as compared to a remainder of the liner or production screen.

Figure 3:
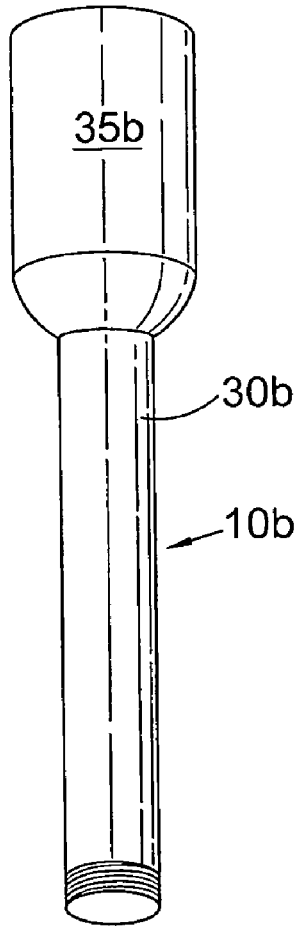
FIG. 3 a side view of a third downhole tool comprising a drill pipe according to an embodiment of the present invention.

Referring to FIG. 3, in a still yet further alternative embodiment the downhole tool or device 10*b* comprises a drill pipe 30*b*. In such case the at least part of the downhole tool or device 10*b* comprises a joint 35*b* of the drill pipe, e.g. at least part of an outermost surface of the joint. The joint 35*b* has an enlarged diameter as compared to a remainder of the drill pipe.

The downhole tool or device 10; 10*a*; 10*b* comprises a tubular member or body 15; 15*a*; 15*b*, beneficially a one piece tubular body. The tubular body 15; 15*a*; 15*b* can substantially consist of a plastics material, e.g. a polymeric plastics material, and beneficially a thermoplastic. Alternatively the tubular body may be made from a metallic material, e.g. steel, iron, ductile iron, zinc or aluminium or an alloy of any of such. Low grade steel or ductile iron are beneficial in view of the price of such. Alternatively again, the tubular body 15; 15*a*; 15*b* can be made from an elastomeric and/or rubber material.

In use, the Tungsten Disulphide comprises a coating and acts as a permanent (coated on) very low friction dry lubricant. The low friction coating can be applied at ambient temperature to form a molecular bond with a substrate material, e.g. the tubular body 15;15*a*;15*b* whether plastic or metal. The coating is typically of the order of 0.5 micron thick. The coating can be applied by use of a jet or jets of refrigerated air.

The Inventor believes Tungsten Disulphide to be suitable for robust downhole use providing a very low coefficient of friction (as compared to materials from which such downhole tools or devices are conventionally made), being chemically inert and withstanding temperatures of up to 650° C. The extensively modified lamellar composition of Tungsten Disulphide outperforms other dry coating lubricants. The coating comprises a dry metallic coating without use of heat, binders or adhesive. The coating comprises a lubricant coating which bonds (instantly) to a substrate material, e.g. plastic, metal, resin, typically with a thickness of around 0.5 microns.

Modified Tungsten Disulphide in laminar form may provide:

a coefficient of friction, e.g. nonlubricated or dry coefficient of friction, of 0.030 dynamic, and 0.070 static;

a load capacity of up to 350,000 psi;

adhesion by molecular bond with no cure time, applied at ambient temperature;

a temperature range providing lubrication from −460° F. to 1200° F. (−273° C. to 650° C.) in normal atmosphere, −350° F. to 2400° F. (−188° C. to 1316° C.) at $10^{-14}$ Torr;

chemical stability being inert, non-toxic, corrosion resistant, and non-magnetic;

compatibility with substrates such as ferrous and non ferrous metals, plastics, polymers;

LOX compatibility, being insensitive to detonation by or in presence of oxygen;

a hardness of approximately 30 Rockwell C; and a thickness of 0.5 microns (0.000020 in).

The coating may be a single layer or laminar.

Figure 4A:
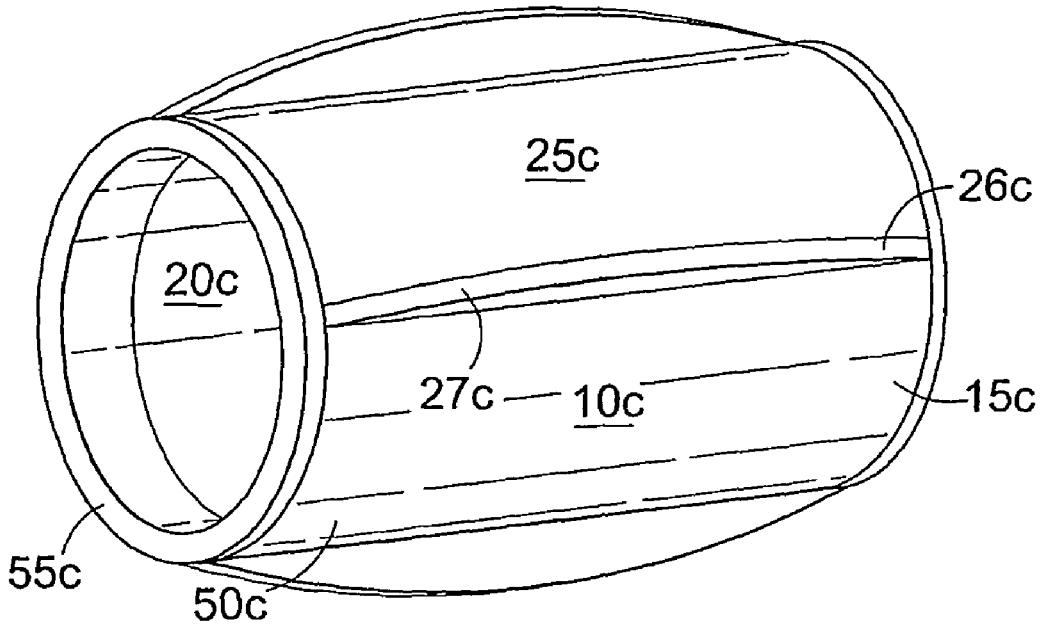
FIG. 4A a perspective view from one side and one end of a fourth downhole tool comprising a casing centraliser according to an embodiment of the present invention.
Figure 4B:
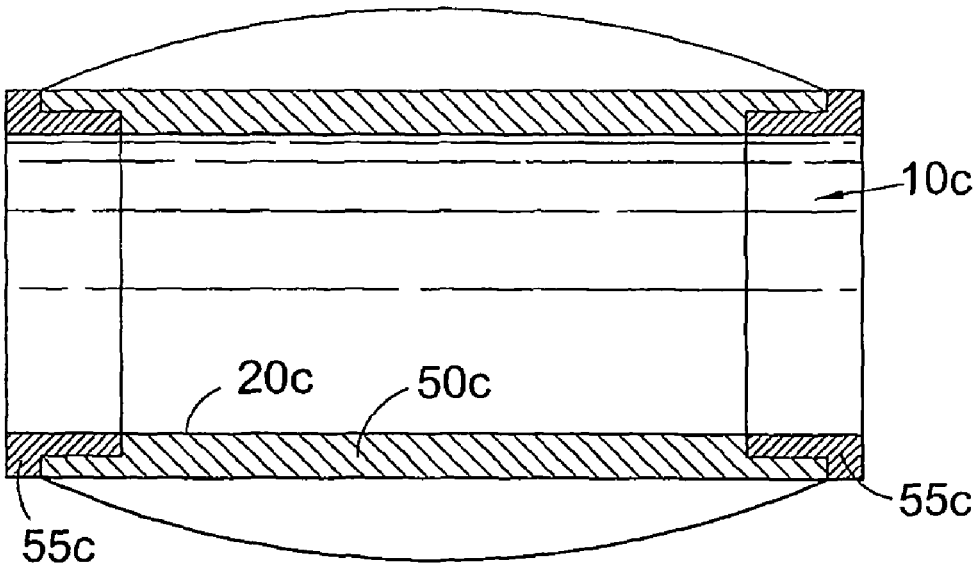
FIG. 4B a cross-sectional side view of the downhole tool of FIG. 4A.

Referring to FIGS. 4A and 4B, there is shown a downhole tool 10*c* according to a fourth embodiment of the present invention.

In this case the downhole tool 10*c* comprises a downhole centraliser comprising a casing, liner or screen centraliser or a production tubing centraliser having a coating of Tungsten Disulphide over at least part of one or more of outer surface 25 thereof, at least outer surfaces 27*c* of blades 26*c*, and/or inner surface 20*c*. In this implementation the downhole centraliser is adapted to be received on a downhole tubular (not shown), in use, so as to be a clearance fit around the downhole tubular such that the downhole centraliser is rotationally and longitudinally moveable relative to the downhole tubular, the downhole centraliser being a rigid tubular body, the tubular body having a first portion 50*c* and at least one second portion, the first portion 50*c* and the at least one second portion 55*c* being statically retained relative to one another, the first portion 50*c* comprising a tubular member 15*c* providing outermost surface 25*c* of the tubular body, the first portion 50*c* being substantially formed from a first material, and the at least one second portion 55*c* comprising a ring member provided at or adjacent to one end of the tubular member 15*c*, the at least one second portion 55*c* being substantially formed from a second material, the first material having a lower Young's modulus than the second material, and wherein the first material substantially comprises a thermoplastic polymer.

The at least one second portion 55*c* comprises a further ring member provided at or adjacent to another end of the tubular member. At least a portion of innermost surface 20*c* of the tubular body is provided by the ring member and optional further ring member.

Figure 5A:
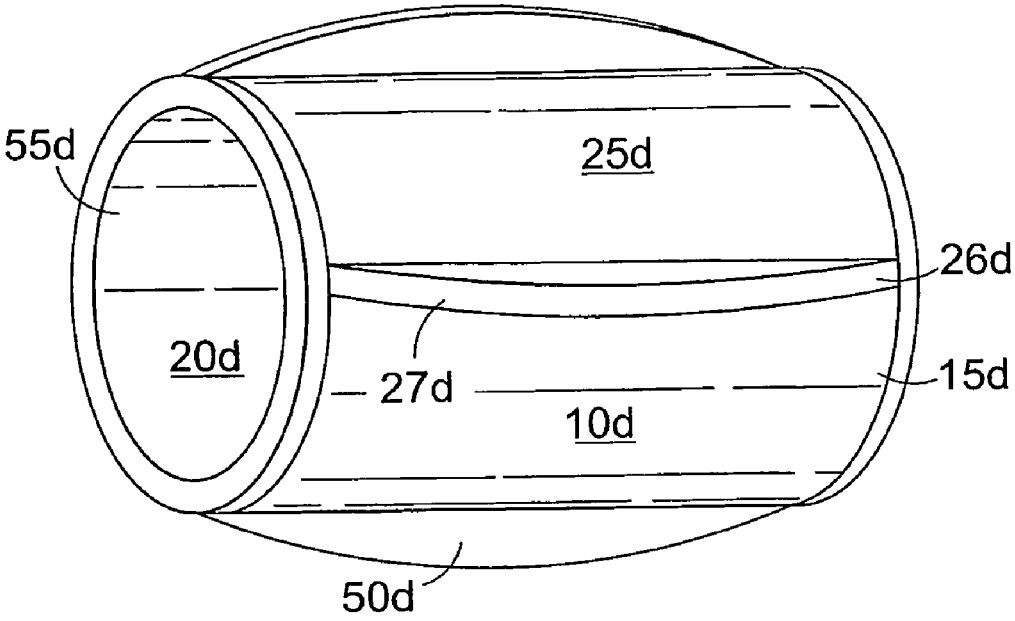
FIG. 5A a perspective view from one side and one end of a fifth downhole tool comprising a casing centraliser according to an embodiment of the present invention.
Figure 5B:
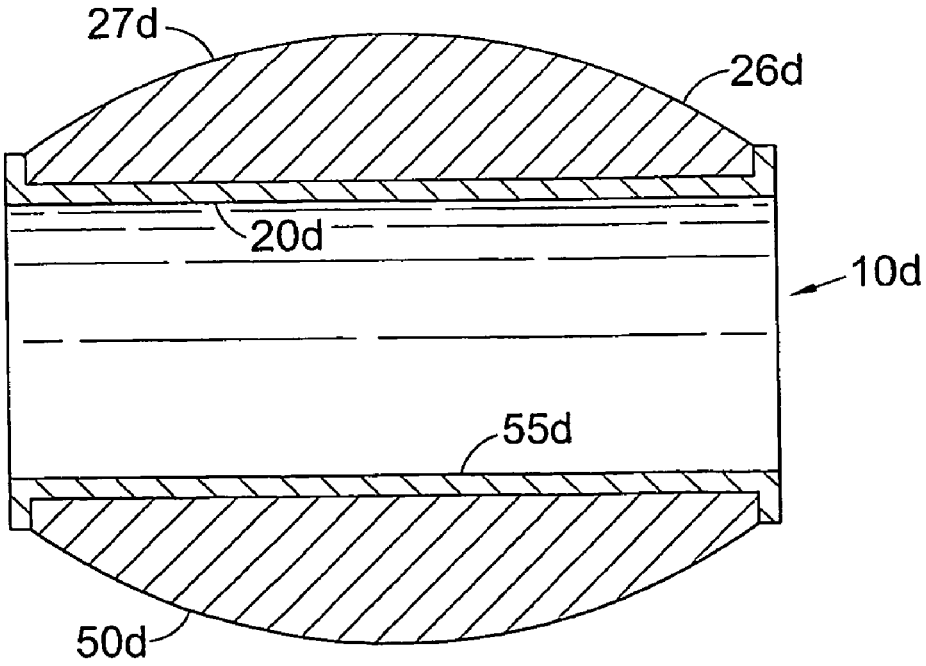
FIG. 5B a cross-sectional side view of the downhole tool of FIG. 5A.
Figure 6:
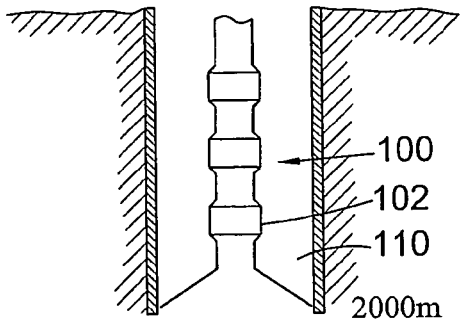
FIG. 6 a side cross-sectional view of a partially drilled borehole of a well including a downhole apparatus comprising a drilling assembly according to an embodiment of the present invention.
Figure 7:
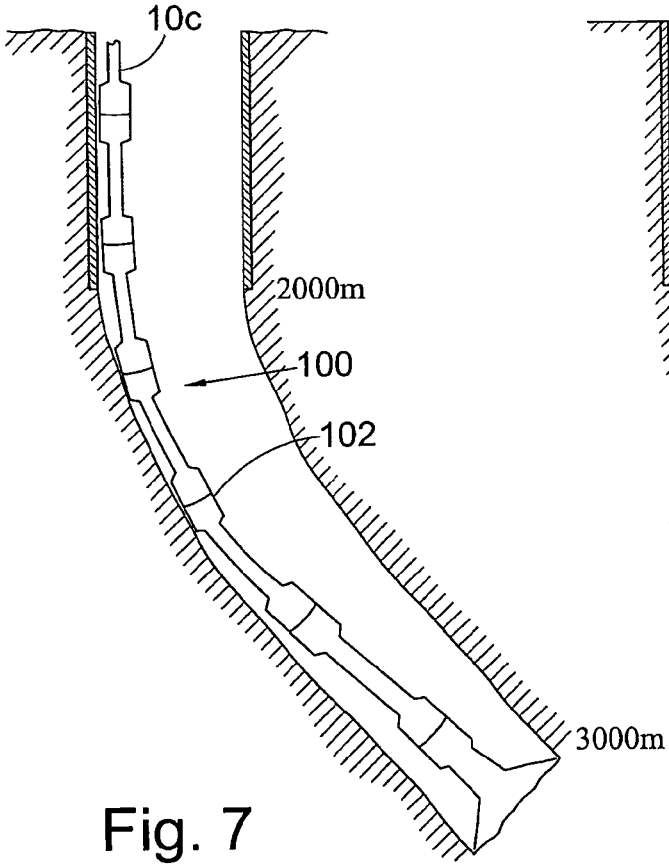
FIG. 7 a side cross-sectional view of the borehole of the well of FIG. 6 including the downhole apparatus comprising the drilling assembly subsequent to further drilling.

Referring now to FIGS. 5A and 5B, there is shown a downhole tool 10*d* according to a fifth embodiment of the present invention. In this case the downhole tool 10*d* comprises a downhole centraliser comprising a casing, liner or screen centraliser or a production tubing centraliser having a coating of Tungsten Disulphide applied to at least part of one or more of outer surface 25*d*, at least outer surfaces 27*d* of blades 26*d* and/or inner surface 20*d*. In this implementation the downhole centraliser is adapted to be received on a downhole tubular (not shown), in use, so as to be a clearance fit around the downhole tubular such that the downhole centraliser is rotationally and longitudinally moveable relative to the downhole tubular, the downhole centraliser being a rigid tubular body, the tubular body having at least one first portion 50*d* and at least one second portion 55*d*, the at least one first portion 50*d* and the at least one second portion 55*d* being statically retained relative to one another, the at least one first portion 50*d* comprising at least a portion of an outermost surface of the tubular body, the at least one first portion 50*d* being substantially formed from a first material, and the at least one second portion 55*d* comprising at least a portion of an innermost surface of the tubular body, the at least one second portion 55*d* being substantially formed from a second material, the first material having a lower Young's modulus than the second material, and wherein the first material substantially comprises a thermoplastic polymer.

The at least one first portion 50*d* comprises a tubular member 15*d* providing the outermost surface of the tubular body, the tubular member 15*d* being substantially formed from the first material, and the at least one second portion 55*d* comprising a further tubular member extending from or adjacent to one end of the tubular member to or adjacent to another end of the tubular member.

The centralisers of FIGS. 4 and 5 can be termed "composite" centralisers. These centralisers are therefore "non-unitary" in construction, that is to say, they are not formed in one piece from one material. They do however, offer a centraliser in which parts made from the first and second materials are static relative to one another, in use. In other words, the centralisers are effectively "one-piece".

The Inventor has termed centralisers of the present invention the "EZEE-GLIDER" (Trade Mark) centraliser.

In the embodiments of FIGS. 4 and 5, the or each first portion 50*d* is circumferentially integrally continuous, that is, formed in one piece.

In one implementation the material of the tubular body or first material is a polyphthalamide (PPA), e.g. a glass-reinforced heat stabilised PPA such as AMODEL, available from Solvay Advanced Polymers (see http://www.solvayadvancedpolymers.com).

In another implementation the material of the tubular body or first material is a polymer of carbon monoxide and alpha-olefins, such as ethylene.

Advantageously, the material of the tubular body or first material is an aliphatic polyketone made from co-polymerisation of ethylene and carbon monoxide—optionally with propylene.

Advantageously, the material of the tubular body or first material is selected from a class of semi-crystalline thermoplastic materials with an alternating olefin-carbon monoxide structure.

In a further implementation the material of the tubular body or first material is a nylon resin. Advantageously the material of the tubular body or first material may be an ionomer modified nylon 66 resin. The material of the tubular body or first material can be a nylon 12 resin, e.g. RILSAN (Trade Mark) available from Elf Atochem.

In a yet further alternative implementation the material of the tubular body or first material is a modified polyamide (PA).

The material of the tubular body or first material can be a nylon compound such as DEVLON (Trade Mark) available from Devlon Engineering Ltd.

The material of the tubular body or first material can be of the polyetheretherketone family, e.g. PEEK (Trade Mark) available from Victrex plc.

The material of the tubular body or first material can be ZYTEL (Trade Mark) available from Du Pont. ZYTEL (Trade Mark) is a class of nylon resins which includes unmodified nylon homopolymers (e.g. PA 66 and PA 612) and copolymers (e.g. PA 66/6 and PA 6T/MPMDT etc) plus modified grades produced by the addition of heat stabilizers, lubricants, ultraviolet screens, nucleating agents, tougheners, reinforcements etc. The majority of resins have molecular weights suited for injection moulding, roto-moulding and some are used in extrusion.

Alternatively the material can be VESCONITE (Trade Mark) available from Vesco Plastics Australia Pty Ltd.

Alternatively the material of the tubular body or first material can be polytetrafluoroethylene (PTFE). In such case the material can be TEFLON (Trade Mark) or a similar type material. PTFE or TEFLON (Trade Mark) filled grades of semi-crystalline thermoplastic materials with an alternatively olefin-carbon monoxide structure may be used. These materials may be suitable for roto-moulding which is a favoured method of manufacture for economic reasons for larger component sizes, e.g. greater than 9⅝" (245 mm). Alternatively, the first material may be PA66, FG30, PTFE 15 from ALBIS Chemicals.

The outermost surface of said body provides or comprise a plurality of raised portions.

The raised portions are in the form of longitudinally extending blades or ribs or may alternatively be in the form of an array of nipples or lobes.

Adjacent raised portions define a flow path therebetween such that fluid flow paths are defined between first and second ends of the tubular body.

Where the raised portions comprise longitudinal blades, such blades form at least in part, substantially parallel to an axis of the tubular body.

Alternatively, the blades form in a longitudinal spiral/helical path on the tubular body.

Advantageously adjacent blades at least partly longitudinally overlap upon the tubular body.

Adjacent blades can be located such that one end of a blade at one end of the tubular body is at substantially the same circumferential position as an end of an adjacent blade at another end of the tubular body.

The blades can have an upper spiral portion, a middle substantially straight portion and a lower tapered portion.

The second material is a metallic material. For example, the second material can be a bronze alloy such as phosphor bronze or lead bronze, or alternatively, zinc or a zinc alloy. In a preferred implementation the second material is lead bronze. Bronze is advantageously selected as it has a high Young's Modulus (16,675,000 psi (115,000 MPa)) compared to ZYTEL (around 600,000 psi (4,138 MPa)) and AMODEL (870,000 psi (6,000 MPa)) while having friction properties which are better than steel.

Additionally, the centraliser optionally includes a reinforcing means such as a cage, mesh, bars, rings and/or the like. The reinforcing means can be made from the second material.

At least part of a tool according to the present invention can be formed from a casting process.

Alternatively or additionally, at least part of the tool according to the present invention is formed from an injection moulding process.

Advantageously, at least part of the tool according to the present invention is formed from an injection moulding or roto-moulding process.

Referring to FIGS. 6 to 11, there is illustrated a downhole apparatus or assembly 100 comprising at least one downhole tool or device 10;10*a*;10*b*;10*c*;10*d*.

The downhole apparatus or assembly 100 comprises a well completion assembly 101, comprising a plurality of lengths of casing 10*a*, a plurality of casing centralisers 10, a plurality of lengths of production tubing, and/or a plurality of production tubing centralisers.

The downhole apparatus or assembly 100 also comprises a drilling assembly 102, comprising a plurality of lengths of drill pipe and/or a plurality of drill pipe protectors, centralisers or stabilisers.

In use, the invention provides a method of completing a well comprising using a downhole tool or device 10;10*a*;10*b*; and a downhole apparatus or assembly 100.

The invention also provides a method of drilling a well comprising using a downhole tool or device 10*b* and a downhole apparatus or assembly.

Referring again to FIGS. 6 to 11, an oil/gas/water well 105 is typically drilled in sections, a process that is repeated with the hole size getting smaller each time.

At the end of a drilling section it is customary to run a length of pipe 10*b* (termed casing if extending back to the surface or liner, if not) into the borehole 110 and to secure the borehole 110 by placing cement in an annulus formed between the outer surface of the pipe 10*b* and the borehole 110. This operation is termed "cementing".

An example of this procedure is shown in FIGS. 6 to 11. A casing 10*a*, typically $13^{3/8}$" in diameter is set and a hole section is drilled with drill pipe 10*b* to a desired depth. Casing 10*a* is then lowered into the well 105. It is shown that the casing 10*a* is held substantially concentrically in the hole 110 by centralisers 10. Centralisers 10 also assist in the smooth running of the casing 10*a*, as such are comprised of a low friction material, and thus promote the smooth running of the casing 10*a*.

Figure 8:
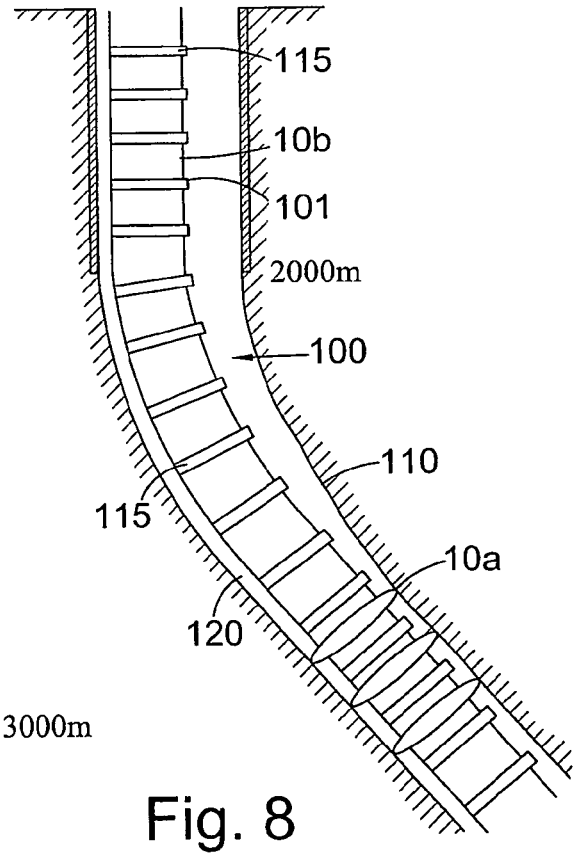
FIG. 8 a side cross-sectional view of the borehole of the well of FIG. 7 subsequent to the drilling assembly being withdrawn and a further downhole apparatus comprising a casing assembly being located within the borehole of the well.

It will be noticed that FIG. 8 shows that the centralisation has not been taken all the way back to surface, so collars 115 of the casing 10*a* may touch a wall 120 of the borehole 110, and the previous casing 10*a*.

Figure 9:
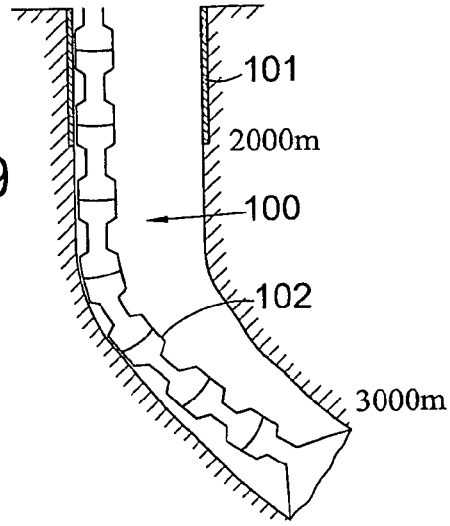
FIG. 9 a cross-sectional side view of the borehole of the well of FIG. 8 with the drilling assembly relocated.
Figure 10:
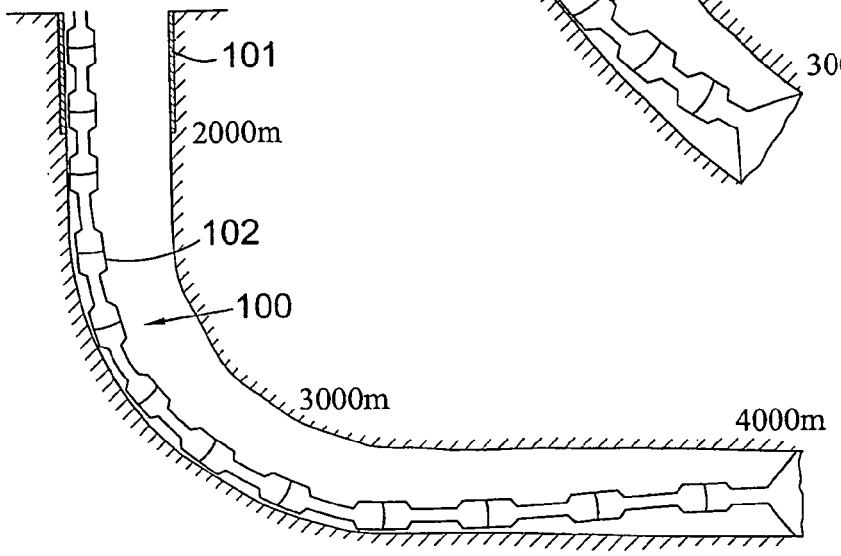
FIG. 10 a cross-sectional side view of the borehole of the well of FIG. 9 including the drilling assembly subsequent to yet further drilling.

FIGS. 9 and 10 show the procedure being repeated—this time once a $9^{5/8}$" casing 10*a* is cemented in an $8^{1/2}$" hole section is drilled. It can be seen that the joints 125 of drill pipe 10*b* will be scraping along the borehole wall section 120, as well as the previous casing 10*a*. Low friction devices have been designed to be placed on drill pipe 10*b* to reduce the friction so caused. An example is GB 2 320 045 (KREUGER). However, the present invention is advantageous over such.

Figure 11:
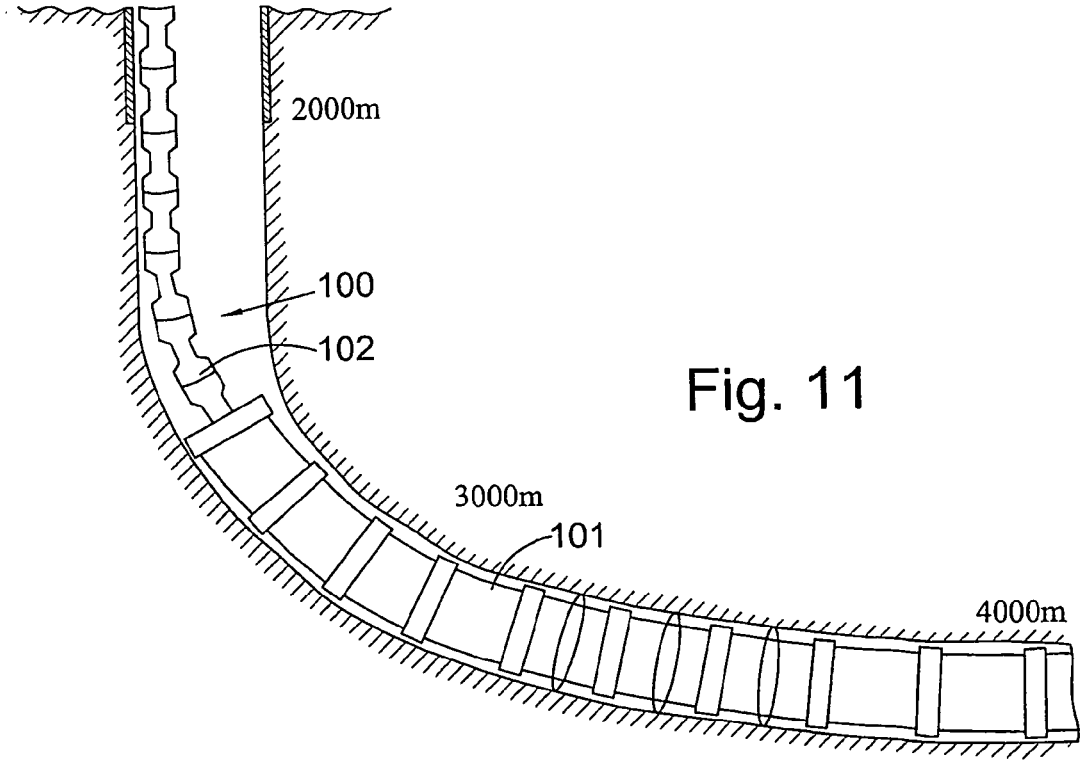
FIG. 11 a cross-sectional side view of the borehole of the well of FIG. 10 including a yet further downhole apparatus comprising a further casing assembly being located within the borehole of the well.

FIG. 11 shows a final length of pipe 10*a* being lowered into the borehole 110. This final pipe 10*f* is typically not run back to surface, but is secured to the previous casing 10*b* (via a hanger). This pipe 10*f* is referred to as a liner. It will be seen that the liner 10*f* is typically centralised for the length of the borehole 110, but may overlap with the previous casing (termed liner lap), which may or may not be centralised. It is crucial that the liner 10*f* has the best possible distribution of cement around it, so during the cementation job, the liner 10*f* is routinely rotated, in an attempt to agitate the cement around the pipe 10*f*.

Clearly for such an operation to be a success, the pipes 10*a*,10*f* need to encounter as low a friction as possible.

It can be understood from the foregoing, that it is desirable to have a low friction environment, both for the drilling of a well, and the running of casings/liners.

When centralisers 10 are used to hold the pipe 10*b* concentric in the hole 110, the centralisers 10 are beneficially made of lower friction materials. This assists the casings 10*a* when being run in hole, as the outer surface of the centralisers are coming in contact with the borehole wall 120. Such also assists in the running of liners 10*f* as both the outside surface of the centraliser 10 needs to be of a low friction material, but so does the inside surface of the centraliser 10, and the liner 10*f* is rotated, and thus the centraliser 10 acts as a bearing.

It can also be appreciated that it is advantageous to have the casing collars and drill pipe joints made of a low friction material, so the whole string of pipe, when run in the hole, acts with the lowest friction possible.

This invention uses a material to coat the surfaces of the casing collars, drill pipe joints and centralisers. The invention can also be extended to coating inside surfaces of the casing to lower the friction of the next hole section.

Typically friction lowering devices have been used in the industry, fitted to both the drill pipe and casing. However, no glue or coating has been found to be adequate to withstand the abrasive forces that the pipe undergoes. The down hole temperature can be in excess of 150° C., which will render most glues useless. Typical low friction materials like PTFE (TEFLON (Trade Mark)), Molybdenum Disulphide and graphite are too soft and will readily wear off, and by their very nature are difficult to glue or fix to a material.

Figure 12:
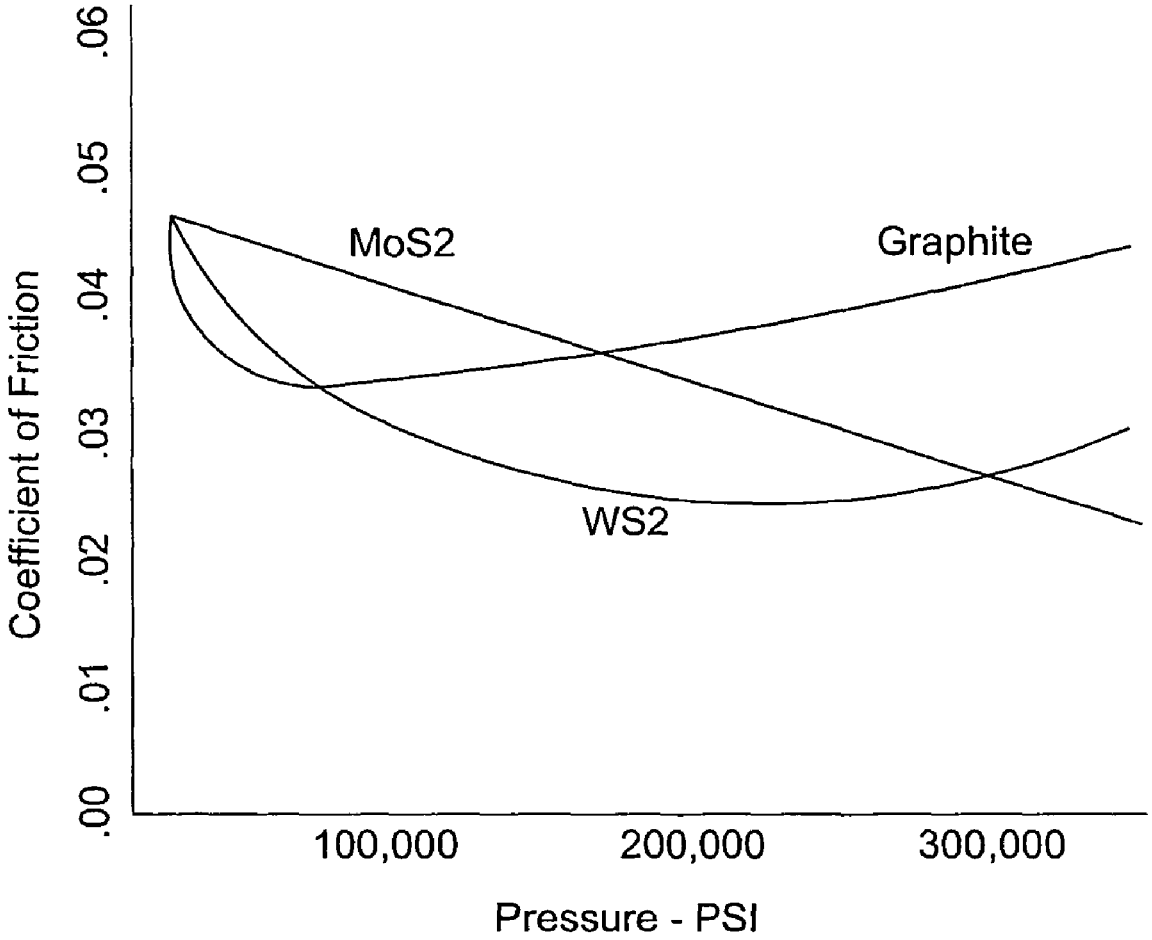
FIG. 12 a graph of coefficient of friction versus pressure for a material used in the embodiments of the present invention.

Referring to FIG. 12, the flat plate Tungsten Disulphide has similar or better friction properties when compared to the aforementioned well known lubricants. Tungsten Disulphide typically has a coefficient of friction of around 0.030. This compares to the figure of 0.250 typically recorded as the steel versus steel friction factor when running casing/liner/drill pipe.

The Tungsten Disulphide material is applied by spraying of the material via a jet of freezing air to the surface desired. This fixes the molecules physically in place and offers great thermal ranges of stability, and the abrasion resistance matches that of the original surface.

It can therefore be seen that it would be advantageous to coat the outside and inside surfaces of centralisers to give as low a friction factor as possible.

However, by treating the whole casing string or liner as a system or assembly, it can also be seen that:

- It is beneficial to coat the outer surface of the casing collars with this material, as the portions that were not centralised would benefit from lower friction.
- It is advantageous to coat the drill pipe tool joints in a similar manner, both to assist the running of liners, and lower the friction of the drilling operation.
- It is envisaged that by treating the inner surfaces of all casings, that this will provide a low friction environment for both drilling and casing running/liner running process.

It will be appreciated that the embodiments of the present invention hereinbefore described are given by way of example only, and are not meant to limit the scope thereof in any way.

It will, for example, be understood that although the disclosed embodiments of the invention provide a particularly elegant solution to problems in the art, the inventive concept may find use in other downhole tools. Examples of such include downhole intervention tools and equipment, completion tools and equipment, and logging tools and equipment, wireline/stickline/coiled tubing/electric cable/electric line/braided cable tools, e.g. toolstring tools, or running, pulling, shifting or associates tools, fishing tools or mono conductor equipment.

The invention claimed is:

1. A downhole tool or device, at least part of the downhole tool or device being made from tungsten disulphide, wherein the at least part of the downhole tool or device comprises at least one surface of the downhole tool or device, and the at least one surface comprises a bearing surface, wherein the downhole tool or device further comprises a substrate material and the tungsten disulphide comprises a coating which is molecularly bonded to the substrate material.

2. A downhole tool or device as claimed in claim 1, wherein the at least one bearing surface comprises a journal bearing surface or a thrust bearing surface or a journal bearing and thrust bearing surface.

3. A downhole tool or device as claimed in claim 1, wherein the at least one surface comprises at least part of an innermost surface of a tubular member.

4. A downhole tool or device as claimed in claim 3, wherein the material of the tubular body is a polymer of carbon monoxide and alpha-olefins, such as ethylene.

5. A downhole tool or device as claimed in claim 3, wherein the material of the tubular body is an aliphatic polyketone made from co-polymerisation of ethylene and carbon monoxide.

6. A downhole tool or device as claimed in claim 3, wherein the material of the tubular body is selected from a class of semi-crystalline thermoplastic materials with an alternating olefin-carbon monoxide structure.

7. A downhole tool or device as claimed in claim 3, wherein the material of the tubular body is a nylon resin.

8. A downhole tool or device as claimed in claim 3, wherein the material of the tubular body is a modified polyamide (PA).

9. A downhole tool or device as claimed in claim 3, wherein the material of the tubular body is a nylon compound.

10. A downhole tool or device as claimed in claim 3, wherein the material of the tubular body is of the polyetheretherketone family.

11. A downhole tool or device as claimed in claim 3, wherein the material of the tubular body is a nylon resin such as an unmodified nylon homopolymer or copolymer.

12. A downhole tool or device as claimed in claim 3, wherein the material of the tubular body is polytetrafluoroethylene (PTFE) or PTFE filled grades of semi-crystalline thermoplastic materials with an alternating olefin-carbon monoxide structure.

13. A downhole tool or device as claimed in claim 1, wherein the at least one surface comprises at least part of an outermost surface of a tubular member.

14. A downhole tool or device as claimed in claim 1, wherein the downhole tool or device comprises a centraliser such as a casing centraliser.

15. A downhole tool or device as claimed in claim 1, wherein the downhole tool comprises a centraliser for a liner or screen.

16. A downhole tool or device as claimed in claim 1, wherein the downhole tool or device comprises a protector, stabiliser or centraliser such as a production tubing protector, stabiliser or centraliser.

17. A downhole tool or device as claimed in claim 1, wherein the downhole tool or device comprises a casing such as a length of casing.

18. A downhole tool or device as claimed in claim 17, wherein the at least part of the downhole tool or device comprises at least part of an outermost surface of a joint of the casing.

19. A downhole tool or device as claimed in claim 18, wherein the joint has an enlarged diameter as compared to a remainder of the casing.

20. A downhole tool or device as claimed in claim 1, wherein the downhole tool or device comprises a liner or production screen.

21. A downhole tool or device as claimed in claim 20, wherein the at least part of the downhole tool or device comprises at least part of an outermost surface of a joint of the liner or production screen.

22. A downhole tool or device as claimed in claim 21, wherein the joint has an enlarged diameter as compared to a remainder of the liner or production screen.

23. A downhole tool or device as claimed in claim 1, wherein the downhole tool or device comprises a drill pipe.

24. A downhole tool or device as claimed in claim 23, wherein the at least part of the downhole tool or device comprises at least part of an outermost surface of a joint of the drill pipe.

25. A downhole tool or device as claimed in claim 24, wherein the joint has an enlarged diameter as compared to a remainder of the drill pipe.

26. A downhole tool or device as claimed in claim 1, wherein the downhole tool or device comprises a tubular body, such as a one piece tubular body.

27. A downhole tool or device as claimed in claim 26, wherein the tubular body is made from a plastics material such as a polymeric plastics material, such as a thermoplastic.

28. A downhole tool or device as claimed in claim 26, wherein the tubular body is made from a metallic material such as steel, iron, ductile iron, zinc or aluminium or an alloy of any of such, such as low grade steel.

29. A downhole tool or device as claimed in claim 26, wherein the tubular body is made from an elastomeric and/or rubber material.

30. A downhole tool or device as claimed in claim 26, wherein the coating acts, in use, as a dry lubricant or low friction coating.

31. A downhole tool or device as claimed in claim 30, wherein the low friction coating is applied at ambient temperature to form a molecular bond with the substrate material.

32. A downhole tool or device as claimed in claim 30, wherein the coating is of the order of 0.5 micron thick.

33. A downhole tool or device as claimed in claim 30, wherein the coating comprises a dry metallic coating without use of heat, binders or adhesive.

34. A downhole tool or device as claimed in claim 30, wherein the coating comprises a lubricant coating which bonds to a substrate material such as a plastic, metal, or resin.

35. A downhole tool or device as claimed in claim 34, wherein the coating has a thickness of around 0.5 microns.

36. A downhole tool or device as claimed in claim 1, wherein the tungsten disulphide has an extensively modified lamellar composition.

37. A downhole tool or device as claimed in claim 1, wherein the tungsten disulphide is a coating comprising a single layer or laminar/multiple layers.

38. A downhole tool or device as claimed in claim 1, wherein the tool comprises a centraliser including a reinforcing means.

39. A downhole tool or device as claimed in claim 38, wherein the reinforcing means is made from a second material.

40. A downhole tool or device as claimed in claim 1, wherein the tungsten disulphide has a coefficient of friction selected from one of less than or equal to 0.1, in the range 0.030 to 0.070, substantially 0.030 or 0.070.

41. A downhole tool or device as claimed in claim 40, wherein the coefficient of friction is a dynamic coefficient of friction.

42. A downhole tool or device as claimed in claim 40, wherein the coefficient of friction is a static coefficient of friction.

43. A downhole tool or device as claimed in claim 1, wherein the substrate material comprises a tubular body.

44. A downhole tool, at least part of the downhole tool being made from tungsten disulphide, wherein the at least part of the downhole tool comprises at least one surface of the downhole tool, and the at least one surface comprises a bearing surface, wherein the tool comprises a downhole centraliser comprising a casing, liner or screen centraliser or a production tubing centraliser, the downhole centraliser being adapted to be received on a downhole tubular, in use, so as to be a clearance fit around the downhole tubular such that the downhole centraliser is rotationally and longitudinally moveable relative to the downhole tubular, the downhole centraliser being a rigid tubular body, the tubular body having a first portion and at least one second portion, the first portion and the at least one second portion being statically retained relative to one another, the first portion comprising a tubular member providing an outermost surface of the tubular body, the first portion being substantially formed from a first material, and the at least one second portion comprising a ring member provided at or adjacent to one end of the tubular member, the at least one second portion being substantially formed from a second material, the first material having a lower Young's modulus than the second material, and wherein the first material substantially comprises a thermoplastic polymer.

45. A downhole tool or device as claimed in claim 44, wherein the at least one second portion comprises a further ring member provided at or adjacent to another end of the tubular member.

46. A downhole tool as claimed in claim 44, wherein at least a portion of an innermost surface of the tubular body is provided by the ring member and further ring member.

47. A downhole tool as claimed in claim 44, wherein the first portion is circumferentially integrally continuous.

48. A downhole tool as claimed in claim 44, wherein the material of the tubular body or first material is a polyphthalamide (PPA) such as a glass-reinforced heat stabilised PPA.

49. A downhole tool as claimed in claim 44, wherein the outermost surface of the body provides or comprises a plurality of raised portions.

50. A downhole tool as claimed in claim 49, wherein the raised portions are in the form of longitudinally extending blades or ribs or are in the form of an array of nipples or lobes.

51. A downhole tool as claimed in claim 50, wherein the blades are formed in a longitudinal spiral/helical path on the tubular body.

52. A downhole tool as claimed in claim 50, wherein adjacent blades at least partly longitudinally overlap upon the tubular body.

53. A downhole tool as claimed in claim 50, wherein adjacent blades are located such that one end of a blade at one end of the tubular body is at substantially the same circumferential position as an end of an adjacent blade at another end of the tubular body.

54. A downhole tool as claimed in claim 50, wherein the blades have an upper spiral portion, a middle substantially straight portion and a lower tapered portion.

55. A downhole tool as claimed in claim 49, wherein adjacent raised portions define a flow path therebetween such that fluid flow paths are defined between first and second ends of the tubular body.

56. A downhole tool as claimed in claim 49, wherein the raised portions comprise longitudinal blades, such blades being formed, at least in part, substantially parallel to an axis of the tubular body.

57. A downhole tool as claimed in claim 44, wherein the second material is a metallic material.

58. A downhole tool as claimed in claim 57, wherein the second material is a bronze alloy or zinc or a zinc alloy.

59. A downhole tool as claimed in claim 57, wherein the second material is lead bronze.

60. A downhole tool as claimed in claim 57, wherein the second material is phosphor bronze.

61. A downhole tool, at least part of the downhole tool being made from tungsten disulphide, wherein the at least part of the downhole tool comprises at least one surface of the downhole tool, and the at least one surface comprises a bearing surface, wherein the tool comprises a downhole centraliser comprising a casing, liner or screen centraliser or a production tubing centraliser, the downhole centraliser being adapted to be received on a downhole tubular, in use, so as to be a clearance fit around the downhole tubular such that the downhole centraliser is rotationally and longitudinally moveable relative to the downhole tubular, the downhole centraliser being a rigid tubular body, the tubular body having at least one first portion and at least one second portion, the at least one first portion and the at least one second portion being statically retained relative to one another, the at least one first portion comprising at least a portion of an outermost surface of the tubular body, the at least one first portion being substantially formed from a first material, and the at least one second portion comprising at least a portion of an innermost surface of the tubular body, the at least one second portion being substantially formed from a second material, the first material having a lower Young's modulus than the second material, and wherein the first material substantially comprises a thermoplastic polymer.

62. A downhole tool or device as claimed in claim 61, wherein the at least one first portion comprises a tubular member providing the outermost surface of the tubular body, the tubular member being substantially formed from the first material, and the at least one second portion comprises a further tubular member extending from or adjacent to one end of the tubular member to or adjacent to another end of the tubular member.

63. A downhole apparatus or assembly comprising at least one downhole tool or device, at least part of the downhole tool or device being made from tungsten disulphide, wherein the at least part of the downhole tool or device comprises at least one surface of the downhole tool or device, and the at least one surface comprises a bearing surface, wherein the downhole tool or device further comprises a substrate material and the tungsten disulphide comprises a coating which is molecularly bonded to the substrate material.

64. A downhole apparatus or assembly as claimed in claim 63, wherein the downhole apparatus or assembly comprises a well completion assembly, or drill string comprising a plurality of lengths of casing, a plurality of casing centralisers, a plurality of lengths of production tubing and/or a plurality of production tubing centralisers.

65. A downhole apparatus or assembly as claimed in claim 63, wherein the downhole apparatus or assembly comprises a drilling assembly or drill string comprising a plurality of lengths of drill pipe and/or a plurality of drill pipe protectors, centralisers or stabilisers.

* * * * *